United States Patent [19]

Sadeh

[11] Patent Number: 4,493,276

[45] Date of Patent: Jan. 15, 1985

[54] POCKET SETTER UNIT AND AUTOMATIC SEWING MACHINE INCLUDING SAME

[75] Inventor: Yaacov Sadeh, Beersheva, Israel

[73] Assignee: Beta Engineering & Development Ltd., Beersheva, Israel

[21] Appl. No.: 400,713

[22] Filed: Jul. 22, 1982

[30] Foreign Application Priority Data

Sep. 29, 1981 [IL] Israel ..... 63930

[51] Int. Cl.[3] ..... D05B 21/00

[52] U.S. Cl. ..... 112/121.12; 112/121.15; 223/38

[58] Field of Search ..... 112/121.12, 121.15, 112/262.3, 265.1, 147, 148, 235, 237, DIG. 3; 2/247; 223/37, 38, 1

[56] References Cited

U.S. PATENT DOCUMENTS 3,552,336 1/1971 Brandriff ..... 112/121.15

3,895,590 7/1975 Perlino ..... 112/121.12

4,362,115 12/1982 Rose et al. ..... 112/DIG. 3

4,445,631 5/1984 Olivares ..... 112/121.15 X

*Primary Examiner*—Peter Nerbun

*Attorney, Agent, or Firm*—Benjamin J. Barish

[57] ABSTRACT

A pocket setter unit attachable to a sewing machine includes a holder for holding the pocket over the garment to which the pocket is to be fixed, the holder including a free space around the portion of the pocket to be stitched to the garment, and a plurality of folding blades disposed around the free space. Each of the folding blades includes an actuator for moving the respective blade from a retracted position along one side of the free space, to an extended position in the free space so as to fold under the respective edge of the pocket and to enable the sewing head to apply stitching through the folded edges in the free space for sewing the pocket to the garment.

4 Claims, 7 Drawing Figures

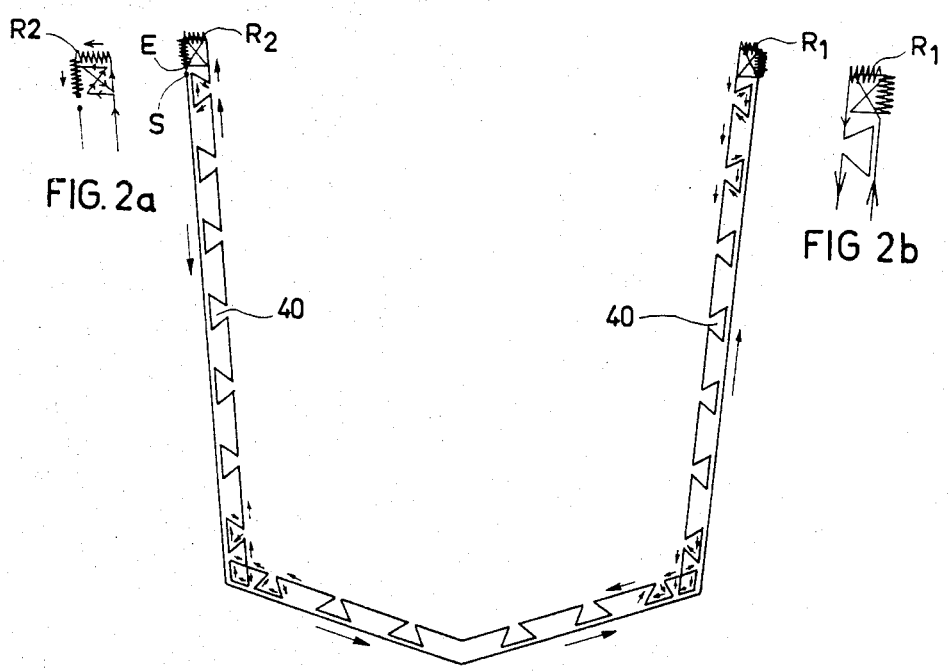
FIG. 2a
FIG 2b
FIG. 2
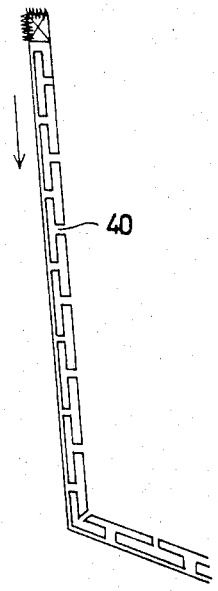
FIG. 3
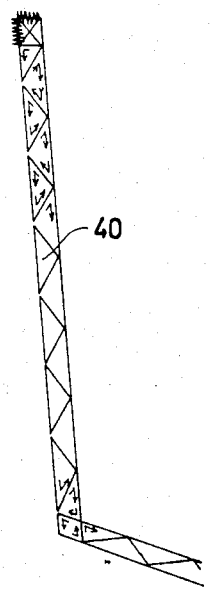
FIG. 4
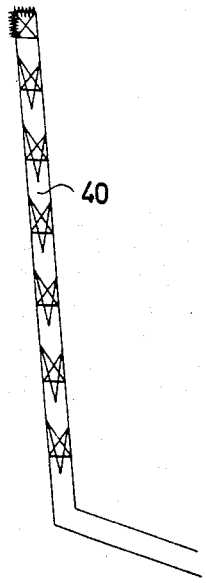
FIG. 5

POCKET SETTER UNIT AND AUTOMATIC SEWING MACHINE INCLUDING SAME

BACKGROUND OF THE INVENTION

The present invention relates to a pocket setter unit for use in sewing pockets to a garment, and also to a sewing machine including such a unit. The invention is particularly useful in automatic sewing machines controlled by a programmed controller, and is therefore described below with respect to such an application.

The manual sewing of pockets to a garment involves the manual operations of marking, setting, sewing and stitch-reinforcement, which are usually performed at two working stations, each one occupied by an operator. It will be appreciated, therefore, that manual pocket setting is slow, costly and tedious.

Pocket setting is also done automatically, but most or all of the known devices are dedicated pocket setters, i.e. they are designed for that special application. As such, such machines have limited use and also limited flexibility in the types of pockets and types of stitchings that can be applied. Most of the dedicated pocket setters apply the stitchings according to a simple pattern of two parallel lines along each stitched edge. The known dedicated pocket setters also generally require highly-skilled personnel, expensive clamps and long delivery time to make style changes.

SUMMARY OF THE INVENTION

An object of the present invention is to provide a pocket setter unit attachable to a sewing machine, and also a sewing machine, having advantages in the above respects.

According to the present invention, there is provided a sewing machine including: a main frame; a sewing head mounted thereon; a carriage displaceable with respect to the sewing head; a loading table laterally of the sewing head; and a pocket setter attached to the carriage to be displaced thereby with respect to the sewing head. The pocket setter includes a holder for holding the pocket over the garment to which the pocket is to be fixed, which holder includes means defining a free space around a portion of the pocket to be stitched to the garment, and a plurality of folding blades disposed around the free space. Each of the folding blades includes an actuator for moving the respective blade from a retracted position along one side of the free space, to an extended position in the free space so as to fold under the respective edge of the pocket and to enable the sewing head to apply stitching through the folded edges in the free space for sewing the pocket to the garment.

The sewing machine further includes a transfer device for transferring the unstitched pocket and the underlying garment laterally from the loading table to the pocket setter unit. This transfer device includes a templet for receiving the pocket over the garment and for conveying both the pocket and the garment to the pocket setter unit.

The sewing machine further includes a program controller controlling the carriage drive, the transfer device, the actuators for the folding blades of the pocket setter, and the sewing head, all according to a selected, stored program.

Also, in the described preferred embodiment, the holder comprises a base plate formed with a cut-out and movably mounted to said carriage, and a presser plate movably mounted to said carriage to overlie said cut-out, said presser plate being of similar configuration but of smaller dimensions than said cut-out of the base plate so as to define therewith said free space, said folding blades being carried by said base plate.

A pocket setter unit constructed in accordance with the foregoing features provides a number of important advantages. Thus, it permits folding and decorative stitching of the pockets to be done automatically under the control of a selected program and at high speed. In addition, it permits the application of multi-directional reinforcement stitches at the ends of the sewn pocket, and also provides a high degree of flexibility in the stitching pattern, configuration of the pockets, and density of the stitches. Moreover, the stitching pattern may be quickly changed, by merely including another program, to accommodate style and size changes. Further, such a pocket setter unit may be attached to existing automatic sewing machines to provide this additional function, or incorporated in an automatic sewing machine in its original form.

Further features and advantages of the invention will be apparent from the description below.

BRIEF DESCRIPTION OF THE DRAWINGS

The invention is herein described, by way of example only, with reference to the accompanying drawings, wherein:

FIG. 2 illustrates one form of stitching pattern that may be applied to the pocket using the machine of FIG. 1;

FIGS. 2*a* and 2*b* illustrate the reinforcements at the ends of the stitching pattern of FIG. 2; and FIGS. 3–5 illustrate examples of three other forms of stitching patterns that may be applied to the pocket.

DESCRIPTION OF A PREFERRED EMBODIMENT

Figure 1:
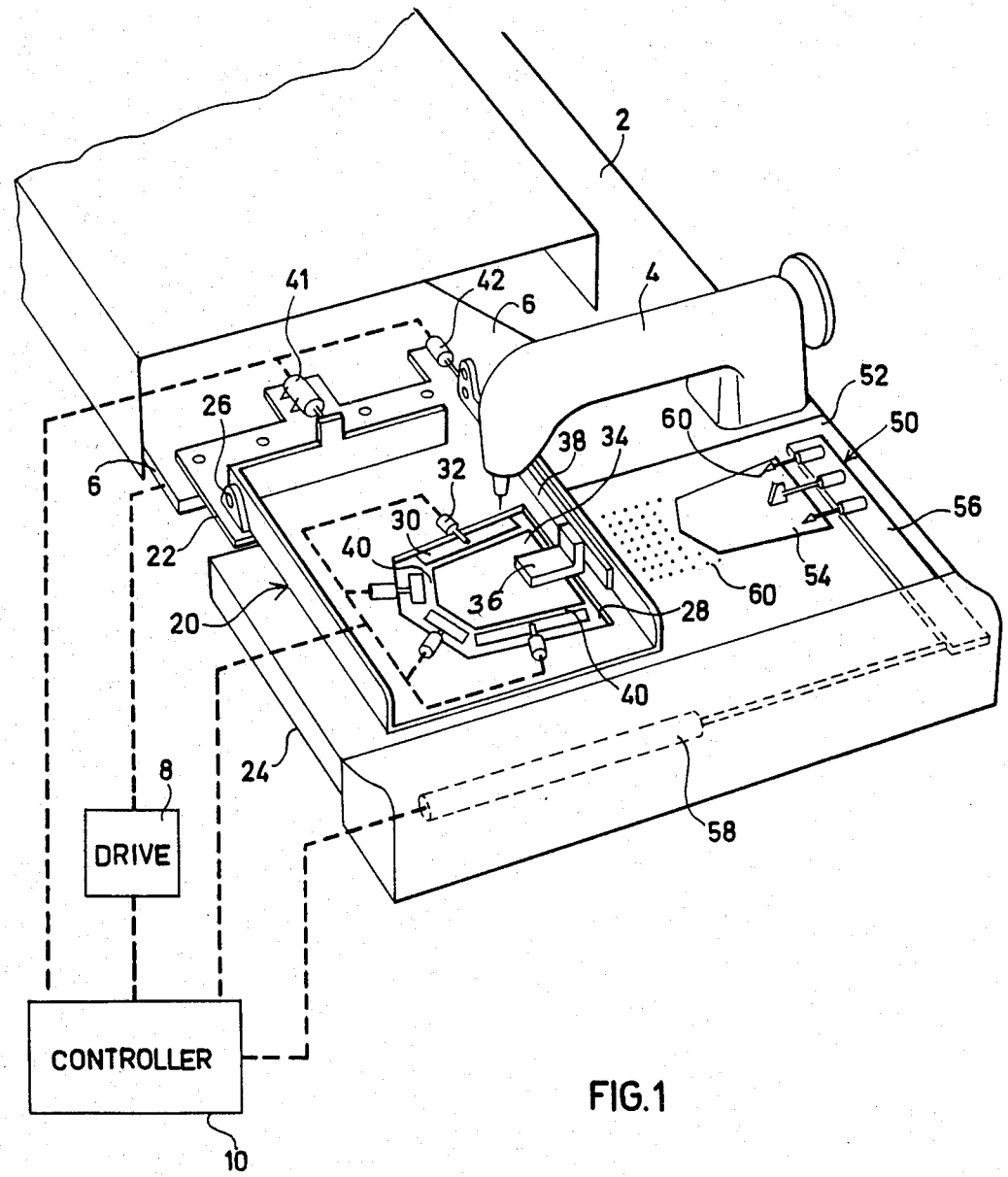
FIG. 1 illustrates one form of sewing machine constructed in accordance with the present invention.

The automatic sewing machine illustrated in FIG. 1 comprises a machine main frame, generally designated 2, on which is fixably mounted a sewing head 4. Also mounted on the machine main frame 2 is a displaceable carriage 6 driven by a carriage drive 8 along the X-axis and the Y-axis in order to position a workpiece carried by the carriage with respect to the fixed sewing head 4. The carriage drive 8 and the sewing head 4 are both controlled in accordance with a selected program introduced into the program controller 10.

Automatic sewing machines of the foregoing type are well-known, one example being the "Encimat MB 3000" manufactured by Beta Engineering & Development Ltd. Accordingly, further details of the construction and operation of such automatic sewing machines are not deemed necessary herein.

In accordance with the present invention, a special pocket setter unit, generally designated 20 in FIG. 1, is attached to the displaceable carriage 6, e.g. by a mounting plate 22. The pocket setter unit 20 includes a base plate 24 pivotably mounted to the mounting plate 22 along axis 26 from an open position to the operative position illustrated in FIG. 1. Base plate 24 is formed with a cut-out 28 configured generally according to, but of slightly larger dimensions than, the pocket to be sewn. Around the cut-out 28 are a plurality of folding blades 30 each carried at the end of a pneumatic actuator 32 so as to be movable either to a retracted position, as illustrated in FIG. 1, or to an actuated position in the cut-out 28.

The pocket setter unit 20 further includes a presser plate 34 carried by a bracket 36 mounted on an arm 38, which arm is also pivotable about the same axis 26 as the base plate 24. Presser plate 34 is of the same general configuration as the cut-out 28 in the base plate 24, but of smaller dimensions, so as to define a free space, generally designated 40, around the presser plate 34. It is in this free space 40 that the stitching is effected by the sewing head 4, as will be described more particularly below.

Base plate 24 is driven either to its open position or to its operative position shown in FIG. 1 by means of a pneumatic actuator 41 controlled by the controller 10. Presser plate 34 is similarly pivoted to either of its two positions by a pneumatic actuator 42 controlled by controller 10.

The apparatus illustrated in FIG. 1 further includes a transfer device, generally designated 50, for transferring the unstitched pocket and the underlying garment from a loading table 52, laterally of the sewing head 4, to the pocket setter unit 20. This transfer of the unstitched pocket and the garment is effected when the base plate 24 and presser plate 34 of the pocket setter unit 20 are both in their pivoted open positions, as will be described more particularly below.

Transfer device 50 comprises a template 54 which is of the exact shape of the pocket to be stitched. Template 54 is carried at the end of an arm 56 actuated by a pneumatic actuator 58 also under the control of controller 10. The unstitched pocket is retained on the upper face of template 54 by means of a plurality of spring clips 60. Template 54 is movable by the schematically-shown actuator 58, not only towards and away from the pocket setter unit 20, but also towards and away from the table 52. Thus, during the transfer operation, the pocket is retained on the upper face of the template 54, whereas the garment to which the pocket is stitched is retained betwen the underface of the template and the upper face of the table 52 as the template is moved towards the pocket setter unit 20 for transferring both the pocket and the garment thereto. To facilitate the transfer of the garment, table 52 is provided with a plurality of air openings, as shown at 60, which separate the garment from the table.

The machine illustrated in FIGS. 1 and 2 operates as follows:

At the start, both the base plate 24 and the presser plate 34 of the pocket setter unit 20 are in their upwardly pivoted positions (not shown in FIG. 1), and the template 54 is in the loading position illustrated in FIG. 1. A pocket is manually loaded onto the upper face of template 54 is releasably retained thereon by the spring clips 60. The garment to which the pocket is to be sewn rests on top of the loading table 52 under the template 54.

Actuator 58 is then actuated first to bring down the template 54 onto the garment, and then to transfer both the garment and the pocket to underlie the base plate 24 and presser plate 34 of the pocket setter unit 20, both of which plates are in their open positions.

Both pneumatic actuators 41 and 42 are then actuated to pivot downwardly the base plate 24 and the presser plate 34, the base plate 24 being pivoted to a position slightly below that of the presser plate 34. During this operation, the folding blades 30 engage the edges of the pocket and bend them downwardly around the edges of the template 54. The actuation of the folding blades 30 is preferably done serially, so that the ends of the folds are permitted to overlie each other. The template 54 is then retracted to its initial (loading) position, leaving the garment retained between the base plate 24 of the pocket setter unit 20, and the pocket retained between the presser plate 34 and the folding blades 30. At this time, the operator can manually reload template 54 with a new pocket.

The carriage 6 of the sewing machine is then actuated, via drive 8 under the control of controller 10, so as to bring the pocket setter unit 20, including the garment and the pocket retained thereby, to underlie the sewing head 4. The folding blades 30 are then retracted, by their pneumatic actuators 32 under the control of controller 10, and the sewing head is actuated to apply the stitchings in the free space 40 according to any decorative pattern desired and as programmed in the controller 10.

FIG. 2 illustrates one such form of stitching pattern that may be used. In this pattern, the stitching begins at point S and then progresses along one side, along the bottom, and then along the opposite side of the pocket, to define the outer stitch line. A plurality of multidirectional stitches are then made to provide the reinforcement $R_1$, as shown in FIG. 2*b*. After this reinforcement is completed, the stitches are then continued according to the decorative pattern illustrated in FIG. 2, to define the inner stitch line as well as intermediate decorative stitches, until the starting end of the stitches is reached, whereupon the multi-directional stitches are formed to provide the reinforcement $R_2$ (FIG. 2*a*) at this end of the stitching pattern, before the stitching is completed at point E.

After the stitching operation has been completed, carriage 6 is actuated to transfer the pocket and garment to which it is stitched to the transfer table 52, whereupon both the base plate 24 and presser plate 34 of the pocket setter unit 20 are pivoted upwardly, permitting the ejection of the workpiece, this being usually done by air jets.

FIGS. 3, 4 and 5 illustrate several other stitching patterns that may be used, it being appreciated that these are provided merely for purposes of example to show the great variety of stitching patterns that can be applied, all as controlled by the program introduced into the controller 10.

While the invention has been described with respect to one preferred embodiment, it will be appreciated that many other variations, modifications and applications of the invention may be made.

What is claimed is:

1. A sewing machine including: a main frame; a sewing head mounted thereon; a carriage displaceable with respect to said sewing head a loading table laterally of said sewing head; a pocket setter attached to said carriage to be displaced thereby with respect to the sewing head; said pocket setter including a holder for holding the pocket over the garment to which the pocket is to be fixed; said holder including means defining a free space around the portion of the pocket to be stitched to the garment, and a plurality of folding blades disposed around said free space, each of said folding blades including an actuator for moving the respective blade from a retracted position along one side of said free space, to an extended position in said free space so as to fold under the respective edge of the pocket and to enable the sewing head to apply stitching through the folded edges in said free space for sewing the pocket to the garment; a transfer device for transferring the unstitched pocket and the underlying garment laterally from said loading table to said pocket setter; said transfer device including a templet for receiving the pocket over the garment and for conveying both the pocket and the garment to said pocket setter unit; and a program controller controlling said carriage drive, said transfer device, said actuators for the folding blades of the pocket setter and said sewing head, all according to a selected stored program.

2. The sewing machine according to claim 1, wherein said holder comprises a base plate formed with a cut-out and movably mounted to said carriage, and a presser plate movably mounted to said carriage to overlie said cut-out, said presser plate being of similar configuration but of smaller dimensions than said cut-out of the base plate so as to define therewith said free space, said folding blades being carried by said base plate.

3. The sewing machine according to claim 1, wherein said template includes clips for retaining the pocket on its upper face, said template being movable toward the loading table for engagement with the garment and for transferring it with the pocket to underlie the base plate and presser plate.

4. The sewing machine according to claim 3, wherein said loading table is formed with air openings for injecting air between it and the garment to facilitate the transfer of the garment by said template.

* * * * *